US008522880B2

(12) United States Patent
Roodenburg et al.

(10) Patent No.: US 8,522,880 B2
(45) Date of Patent: Sep. 3, 2013

(54) FLOATING OFFSHORE STRUCTURE FOR HYDROCARBON PRODUCTION

(75) Inventors: Joop Roodenburg, Delft (NL); Pieter Dirk Melis Van Duivendijk, Missouri City, TX (US)

(73) Assignee: ITREC B.V., Schiedam (NL)

( * ) Notice: Subject to any disclaimer, the term of this patent is extended or adjusted under 35 U.S.C. 154(b) by 149 days.

(21) Appl. No.: 12/990,357

(22) PCT Filed: Apr. 28, 2009

(86) PCT No.: PCT/NL2009/000107

§ 371 (c)(1),
(2), (4) Date: Jan. 14, 2011

(87) PCT Pub. No.: WO2009/134125

PCT Pub. Date: Nov. 5, 2009

(65) Prior Publication Data

US 2011/0100639 A1 May 5, 2011

Related U.S. Application Data

(60) Provisional application No. 61/071,448, filed on Apr. 29, 2008.

(51) Int. Cl.
*E21B 7/12* (2006.01)

(52) U.S. Cl.
USPC ..... 166/339; 166/340; 166/344; 166/348

(58) Field of Classification Search
USPC ..... 166/339, 340, 344, 348, 351, 352, 166/358, 360, 367, 378–380, 85.1, 75.14; 405/195.1, 223.1
See application file for complete search history.

(56) References Cited

U.S. PATENT DOCUMENTS

| | | | | | |
|---|---|---|---|---|---|
| 3,189,093 | A | * | 6/1965 | De Vries | 166/354 |
| 3,895,677 | A | * | 7/1975 | Bokenkamp | 166/359 |
| 4,108,318 | A | * | 8/1978 | Rode et al. | 414/22.51 |
| 4,227,831 | A | * | 10/1980 | Evans | 405/196 |
| 4,230,190 | A | * | 10/1980 | Guinn et al. | 175/5 |
| 4,260,287 | A | * | 4/1981 | Uyeda et al. | 405/168.3 |
| 4,367,796 | A | * | 1/1983 | Bolding | 166/341 |
| 4,401,398 | A | * | 8/1983 | Remson | 405/201 |

(Continued)

FOREIGN PATENT DOCUMENTS

| | | |
|---|---|---|
| FR | 2 747 728 | 10/1997 |
| WO | WO 00/58598 A1 | 10/2000 |
| WO | WO 01/16458 A1 | 3/2001 |
| WO | WO 2008/118914 A1 | 10/2008 |

*Primary Examiner* — Matthew Buck
*Assistant Examiner* — Aaron Lembo
(74) *Attorney, Agent, or Firm* — Birch, Stewart, Kolasch & Birch, LLP

(57) ABSTRACT

A floating structure includes a riser support system. The riser support system includes multiple carts, each suitable for moveably connecting a risers to the riser support system. A cart includes a support frame and one or more riser tensioners for connecting the support frame to a riser. Each cart is designed for being supported by a cart support structure in a production dock and in a drilling dock, and for being transferred by a crane between the production dock and the drilling dock. Thus, the riser support system enables transferring risers and their riser tensioners within the moonpool from a production dock to a drilling dock without the need of disconnecting and/or reconnecting the risers to extra riser tensioners for support in the drilling dock or during transport.

20 Claims, 6 Drawing Sheets

(56) References Cited

U.S. PATENT DOCUMENTS

| | | | | |
|---|---|---|---|---|
| 4,446,807 | A * | 5/1984 | Johnson et al. | 114/230.23 |
| 4,470,721 | A | 9/1984 | Shotbolt | |
| 4,716,972 | A * | 1/1988 | Makinen et al. | 175/8 |
| 5,135,327 | A | 8/1992 | White et al. | |
| 6,217,258 | B1 * | 4/2001 | Yamamoto et al. | 405/201 |
| 6,692,193 | B2 * | 2/2004 | Beynet et al. | 405/224.4 |
| 6,926,488 | B1 * | 8/2005 | Bolding et al. | 414/22.62 |
| 7,451,821 | B2 * | 11/2008 | Rashid et al. | 166/358 |
| 7,509,919 | B2 * | 3/2009 | Sebellin | 114/258 |
| 7,628,225 | B2 * | 12/2009 | Petersson et al. | 175/5 |
| 7,631,704 | B2 * | 12/2009 | Hagemeyer et al. | 175/52 |
| 7,802,636 | B2 * | 9/2010 | Childers et al. | 175/52 |
| 7,806,628 | B2 * | 10/2010 | Willis | 405/166 |
| 7,814,992 | B2 * | 10/2010 | Olsen | 175/85 |
| 7,886,845 | B2 * | 2/2011 | King et al. | 175/40 |
| 7,891,909 | B2 * | 2/2011 | Tahar et al. | 405/195.1 |
| 7,988,384 | B2 * | 8/2011 | Baugh et al. | 405/195.1 |
| 8,052,369 | B2 * | 11/2011 | Often et al. | 414/22.55 |
| 8,079,426 | B2 * | 12/2011 | Petersson | 175/5 |
| 8,181,698 | B2 * | 5/2012 | Springett et al. | 166/52 |
| 2003/0159853 | A1 | 8/2003 | Archibald et al. | |
| 2008/0289876 | A1 * | 11/2008 | King et al. | 175/40 |
| 2009/0025937 | A1 * | 1/2009 | Robinson et al. | 166/351 |
| 2009/0103984 | A1 * | 4/2009 | Zarisfi | 405/168.1 |
| 2010/0307768 | A1 * | 12/2010 | Bell | 166/382 |
| 2010/0326672 | A1 * | 12/2010 | Childers et al. | 166/380 |
| 2011/0142590 | A1 * | 6/2011 | Chow et al. | 414/800 |

* cited by examiner

FLOATING OFFSHORE STRUCTURE FOR HYDROCARBON PRODUCTION

The invention relates to a floating offshore structure for offshore hydrocarbon production and to a riser support system for use with such a floating offshore structure.

With the gradual depletion of hydrocarbon reserves found offshore, there has been considerable attention attracted to the drilling and production of oil and gas wells located in water. In relatively shallow water, wells may be drilled in the ocean floor from bottom founded, fixed platforms. In deeper water, floating drilling and production systems such as ship-shape drill ships and semi-submersible buoyant platforms are commonly used.

For the production of hydrocarbon from deep water well systems, preferably a Tension Leg Platform (TLP) is used. A TLP consist of floating structure tethered to the seabed in a manner that eliminates most vertical movement of the structure. The primary interest in the TLP concept is that the stiff restraint of vertical motions makes it possible to tie-back wells drilled into the sea floor to production facilities on the floating structure through a collection of pressure containment means (e.g., the valves of a well "tree") such that the pressure containment means are located above the body of water within the dry confines of the floating structure. This "dry tree" concept is very attractive for oil field development because it allows direct access to the wells for maintenance and workover for the purpose of restoring, prolonging or enhancing the production of hydrocarbons.

The pressure containment means are connected to the upper ends of the risers, which risers extend between the well at the sea floor and the pressure containment means on the structure. Via the riser the hydrocarbons are transported to the production facilities. The risers reach the surface in a central cavity of the floating support that is referred to as a "moonpool". The cavity passes right through the hull. It is generally installed on the axis of the floating support, at equal distances from its ends since this is the zone in which the amplitudes of movements and of accelerations are the smallest when the vessel is subjected to the phenomena of roll, pitch, and yaw.

Although a TLP is tethered to the seabed such that most vertical movement is eliminated, due to waves the distance between the TLP and the sea floor will vary. Therefore, the top ends of the risers are connected to the TLP via riser tensioners, supporting the risers while at the same time allowing movement between the risers and the floating structure.

A riser tensioner commonly comprises hydraulic actuators and may in addition be provided with a cable tensioning system using winches. Furthermore, a riser can be provided with floating means distributed along its riser body and installed at various depths to support the riser.

A TLP is provided with a drilling tower to perform the drilling, production, and maintenance operations required on the multiple risers. To enable one drilling tower to be used with multiple risers, it is known to provide a drilling tower which can be moved over a deck by means of a slideway system. The drilling tower can thus be brought selectively into vertical alignment with the top end of any one of the risers. The riser is positioned in the firing line so as to perform drilling operations or maintenance operations on the well.

In combination with moving the tower, specific equipment, for example to perform maintenance operations on the risers, needs to be moved as well. Therefore such a drilling tower is of considerable size and complexity, and thus very heavy and expensive.

In addition, due to their size, moveable drilling towers have a substantial surface area. This makes them, and thus the floating structure, susceptible to wind which may force the TLP out off its position above the wells at the sea floor.

Also, the means required for moving the tower from one well to another and for keeping it in position during operations on any particular well give rise to structures that are complex and expensive.

Furthermore, given that the surface wellheads situated at the top ends of the risers must have a center-to-center spacing of several meters, the drilling tower needs to be displaceable over an extensive area. The weight of such a drilling tower requires large means for balancing the load on the floating support, e.g. in the form of ballast, when the drilling tower is moved relative to the centre of the off shore structure.

As an alternative to a moving drilling tower it is known from French patent publication 2 747 728 to move a section of the platform supporting the multiple riser ends relative to a fixed drilling tower. However, displacement of the risers relative to the offshore platform causes extensive tension and/or twisting forces to be applied to the risers giving rise to a force component which, by reaction on the floating structure, gives rise to considerable levels of force between the floating support and the section supporting the risers. This may force the TLP out off its position above the wells at the sea floor.

As a further alternative it is known from United States patent publication 4 470 721 to transport the riser by crane from a production location to a drilling location under a fixed drilling tower. Such a travelling crane includes a tensioning system capable of maintaining the riser in tension while it is being transferred from its production location to its location on the axis of the drilling tower where well drilling or reconditioning operations are performed. Known cranes are provided with a pulley arrangements through which pass tensioning cables connected at their lower ends to a riser and at their other ends to tensioning means for applying tension to the cable and hence to the riser. The tensioning means are located in an area peripheral to the moonpool. Such cranes require a lot of space and are complicated and therefore expensive.

The object of the present invention is to provide a novel type of floating offshore structure for offshore hydrocarbon production in which risers can be transferred between a production location to a drilling location within the moonpool by displacing the risers individually without the need of a complicated crane.

It is a further object of the invention to provide a novel floating offshore structure in which transferring a riser between a production location and a drilling location within the moonpool is simple to perform and can be done in complete safety.

Therefore, the invention provides a floating offshore structure for offshore hydrocarbon production according to claim 1 and a riser support system for use with such an offshore structure according to claim 12.

The riser support system supported by the offshore structure in the moonpool is able to support multiple risers. The risers can be supported in the multiple production docks in production locations and in at least one drilling dock in a drilling location under a drilling station, and are thus supported in a production position or a drilling position respectively.

The drilling station comprises a drilling tower, multi purpose tower or derrick, and in line with the firing line of the drilling equipment. Therefore, the upper ends of the risers are connected via one or more riser tensioners to the support frames of the carts. These carts are designed for being supported by the cart support structure in a production dock and in a drilling dock. Furthermore, the carts are designed for being transferred by the crane between a production dock and the drilling dock.

Thus a cart may connect the upper end of a riser to the riser support system, i.e. to the floating structure, while enabling movement of the riser relative to the floating structure by a crane. Because the cart comprises riser tensioners for supporting the risers, the crane does not need a complicated system for applying tension to the riser. Thus the crane can be of a simple design.

Also, the support frames of the carts functions as an interface between the riser tensioners and the crane or cart support structure. Thus the system can be used with different types of risers and/or riser tensioners, and can thus be adapted to specific requirements such as for example the depth of a well i.e. the length and seize of the risers to be used.

Furthermore, because the risers are moved in combination with the riser tensioners supporting them, the riser tensioners do not need to be disconnected and reconnected to riser tensioners. This facilitates the process of moving a riser and therefore minimizes the risk of accidents. Preferably, the crane guide supporting the crane extends within a substantial horizontal plane above the cart support structure.

The crane can thus be supported at some distance above the cart support structure supporting the cart, providing room for example pressure containment means mounted on the riser ends to be moved with the riser end in the space between the crane guide and the support structure. Furthermore, the crane guides in this position do not obstruct movement of the riser from one location in the moonpool to another location in the moonpool. Furthermore, when the crane guide is positioned above the riser ends and the pressure containment means, it can extend freely from one side of the moonpool to the other side of the moonpool which facilitates connecting the guide to the floating structure for support.

Furthermore, the crane supported by a crane guide supported above the cart support structure preferably comprises a frame extending in a downward direction from the crane guide, the frame comprising a transport dock for supporting one of the multiple carts. Supporting the cart via the frame allows a stiff support, for example compared to the use of a hoist system. Therefore no extra guides need to be provided for preventing the force exerted by the riser on the crane from moving the part of the crane carrying the cart out of position.

In a further preferred embodiment, the multiple production docks and the drilling dock are provided on opposite sides of the transport track and at the same level as the transport dock of the crane, such that by moving the crane along the crane guide the transport dock can be located next to one of the multiple production docks or the drilling dock for receiving one of the multiple carts supported by that production dock or drilling dock respectively.

Since the docks for supporting the carts are provided at the same level, the carts need to be displaced in a substantial horizontal direction for transfer from for example a production dock to the transport dock in the crane or visa versa. The system for moving the cart can be of a simple design since it only needs to lift and/or lower the carts over a minimal distance or does not need to lift or lower the carts at all.

In a further preferred embodiment, the multiple production docks, the drilling dock and the transport dock all comprise cart guides for slideable supporting one of the multiple carts. The cart guides extend in a substantial horizontal plane such that one of the carts can be slid (or skidded) in a substantial horizontal direction from one of the multiple production docks or the drilling dock into the transport dock of the crane when the crane is located next to the one of the multiple production docks or the drilling dock respectively.

Preferably, the multiple production docks are distributed along the perimeter of the moonpool, and the drilling dock is located near the centre of the moonpool. Thus the chance of a riser being transferred between a production dock and the drilling dock contacting, and possibly damaging, another riser is limited. Furthermore, by positioning the drilling dock central to the production docks, the average distance between the different production docks and the drilling dock, i.e. the time needed to for transferring a riser, is limited.

Preferably, the crane guide extends in a linear direction. Such a crane guide is simple in construction and therefore can be made at low costs.

Preferably, the riser support system comprises multiple cranes each being movable supported by a crane guide. Thus, one crane may transfer a first cart from the drilling dock to a production dock while the second crane moves a second cart from a production dock to the drilling dock. Thus a riser in the drilling dock can relatively quickly be replaced with another riser.

Thus, the present invention provides an offshore structure and a riser support system that enable a group of hydrocarbon wells to be drilled, maintained and produce hydrocarbons without it being necessary to displace the drilling station relative to the offshore structure and without the need of a complicated crane in order to operate on a particular well selected from the group of wells. More particularly, the invention enables movement of individual risers between a dock in a production location and a dock in a drilling location without the need of a complicated crane. Thus the production platform and drilling system can have a fixed central drilling station such that drilling station loads are applied to the platform centre, and support equipment of the drilling station can be placed beneath the deck.

Thus, the structure of the offshore platform, the riser support system and the drilling station can be of a simple and compact design, enabling low cost production and minimized susceptibility to winds. Furthermore, the carts enable transfer of the riser and the riser tensioners connected to it, together. The risers can thus be transferred in a simple and safe manner.

Advantageous embodiments of the offshore structure and the riser supports system are disclosed in the subclaims and in the description referring to the drawings.

In the drawings

FIG. 1 shows a side view of a floating offshore structure 1 for offshore hydrocarbon production according to the invention. In the embodiment shown, the floating structure is a Tension Leg Platform tethered to the seabed via tension legs 20.

Figure 1:
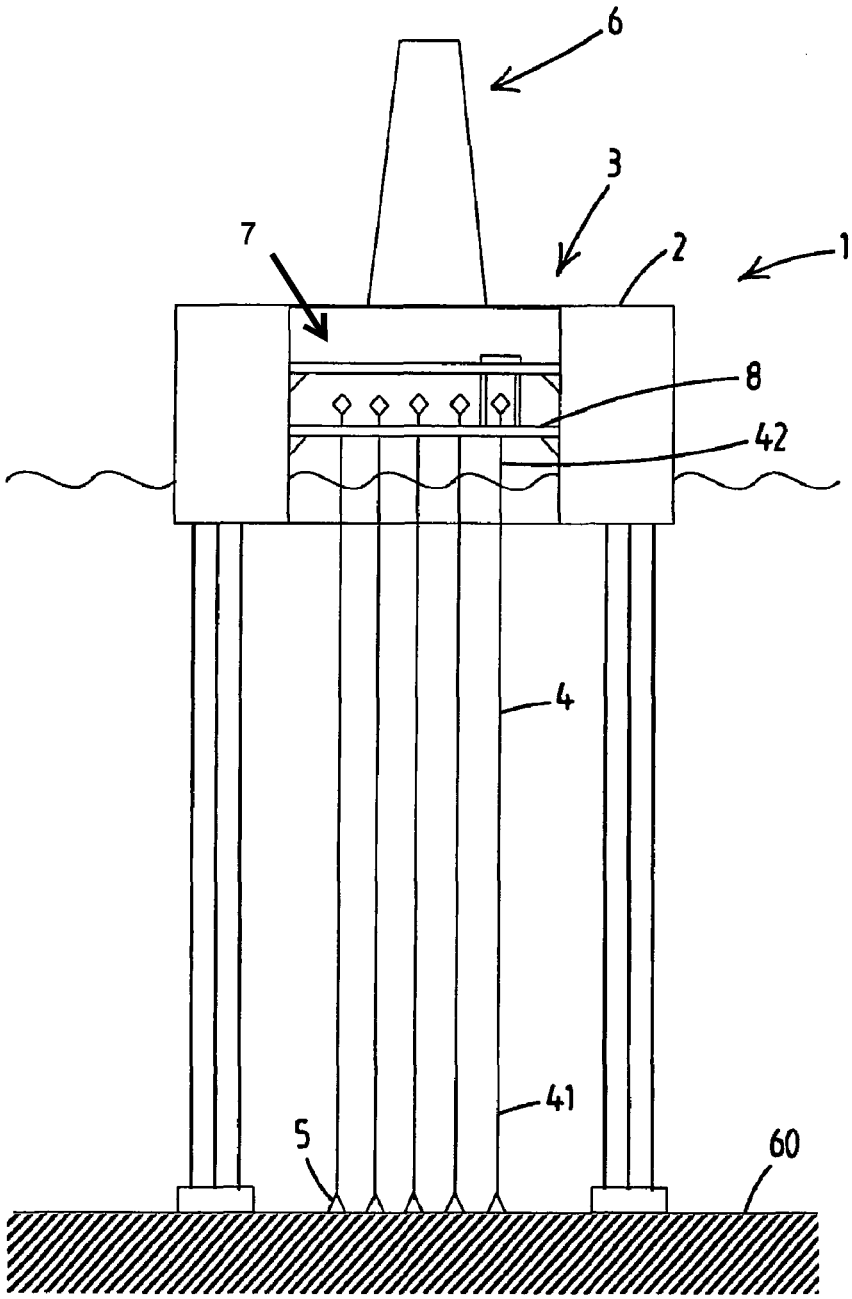
FIG. 1 shows schematic, side view in section of a floating offshore structure for offshore hydrocarbon production according to the invention.

The floating structure shown comprises a moonpool 3 for receiving multiple risers 4. The floating structure 1 furthermore supports a riser support system 7 in the moonpool 3, for supporting the multiple risers 4. The risers have a lower end 41 connected to a hydrocarbon well 5 on a sea floor 60 and an upper end 42 located in the moonpool. A riser support system according to the invention may also be used for risers connected to other types of sub sea wells, for example a water injection well.

The riser support system 7 shown comprises a cart support structure 8 and multiple carts 13. A riser cart support structure according to the invention defines multiple production docks 9 and at least one drilling dock 10, each dock 9, 10 suitable for supporting a cart 13.

Preferably, the support system is supported via support beams (not shown) crossing the moonpool. In such a configuration, the support structure, in particular the middle deck of the support structure is hung at the support beams. The crane guides are also supported by the support beams. The support beams may for example run level with the crane guides to enable the crane to run along the crane guides without being blocked by the support beams.

A drilling station 6 is located on a deck 2 of the floating structure, above the moonpool 3. Such a drilling station comprises a drilling tower such as a derrick, or multi purpose tower, and drilling equipment (not shown) defining a firing line. In the embodiment shown the drilling station 6 comprises a multipurpose tower (not shown) defining two firing lines, situated on opposite sides of the drilling station. Thus the support system comprises two drilling docks, one for each firing line. One drilling dock may for example be used as the primary drilling location while the other may be used for well completion, or both locations may be used for drilling as well as well completion, etc. Multi purpose towers are known from for example WO 2007/020275 and will therefore not be elaborated upon.

A riser support system according to the invention comprises a crane which is movable supported by a crane guide for movement along a transport track, which crane guide extends within a substantial horizontal plane and bridges at least part of the moonpool, for transferring one of the multiple risers between one of the multiple production docks and the drilling dock.

In the particular embodiment shown, the riser support system 7 comprises two cranes 11 which are both movable supported by their own crane guide 12. The crane guides 12 extend in a linear direction, parallel to each other, on opposite sides of the drilling station and parallel to the longitudinal direction of the moonpool.

The multiple carts 13 each comprise a support frame 14 and one or more riser tensioners 15 for connecting the support frame 14 to the upper end 42 of the one of the multiple risers 4. Each cart 13 is furthermore designed for being supported by the cart support structure 8 in a production dock 9 for supporting one of the multiple risers 4 in a production position, and for being supported by the cart support structure 8 in a drilling dock 10 for supporting one of the multiple risers 4 in a drilling position under the drilling station 6 and in line with the firing line.

Furthermore, each cart is designed for being transferred by the crane 11 between a production dock 9 and the drilling dock 10.

The riser support system enables transferring risers and their riser tensioners within the moonpool from a production dock to a drilling dock. In the drilling dock drilling operations and heavy maintenance operations can be performed on a well, i.e. using a drilling station that is fixed relative to the floating support. Since the riser is transferred with its riser tensioners there is no need for reconnecting the risers to other riser tensioners for support the riser in the drilling dock or during transport.

Figure 2:
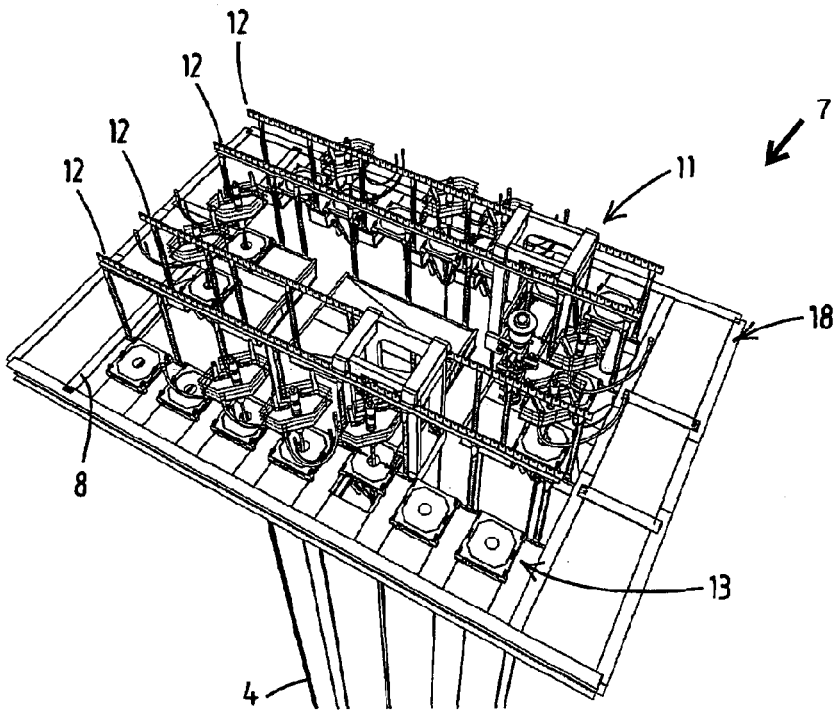
FIG. 2 shows a schematic view in perspective of a support system according to the invention.
Figure 3:
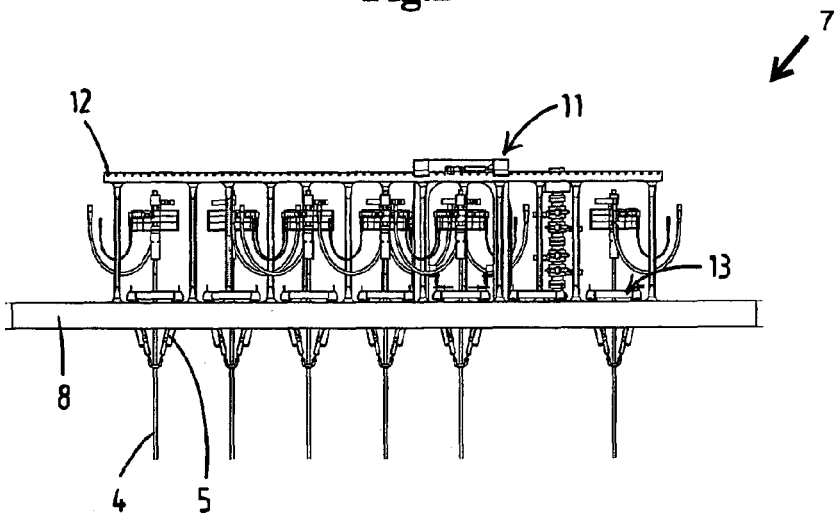
FIG. 3 shows a schematic side view of the support system of FIG. 2.
Figure 4:
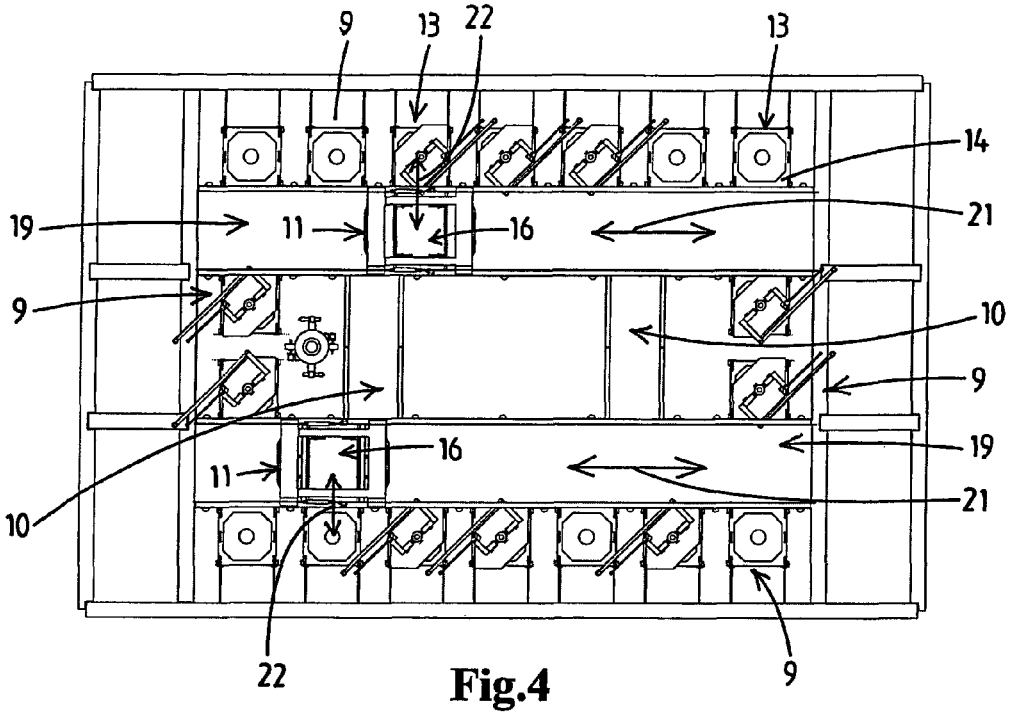
FIG. 4 shows a schematic top view of a the support system of FIG. 2 in a first working position.
Figure 5:
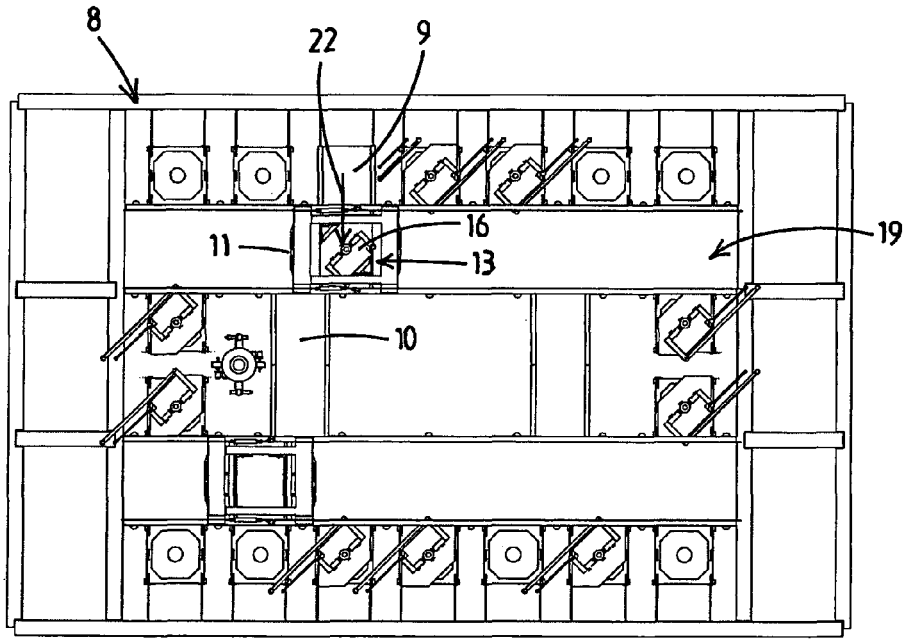
FIG. 5 shows a schematic top view of a the support system of FIG. 2 in a second working position.
Figure 6:
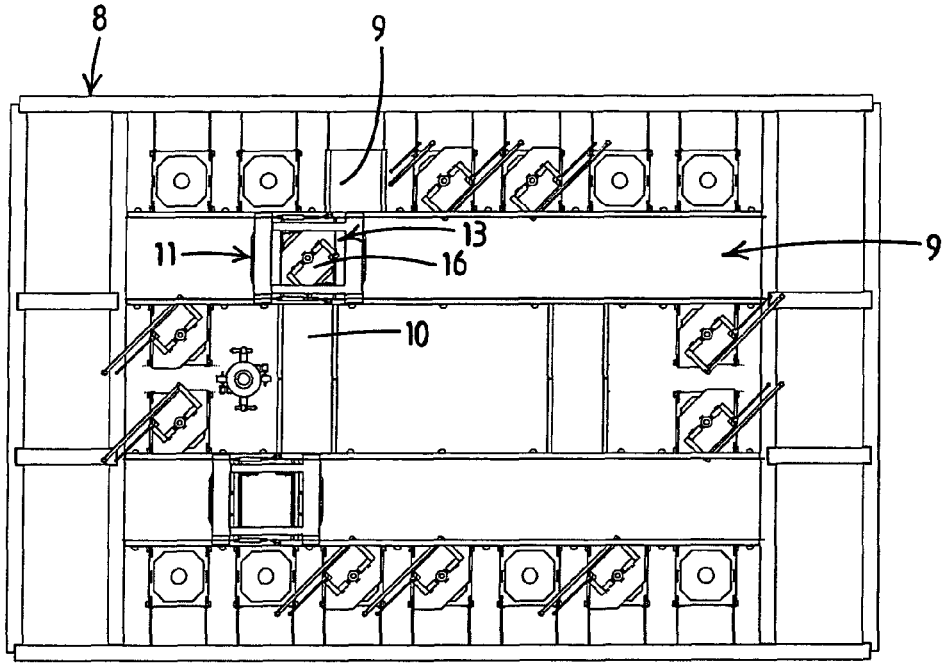
FIG. 6 shows a schematic top view of a the support system of FIG. 2 in a third working position.
Figure 7:
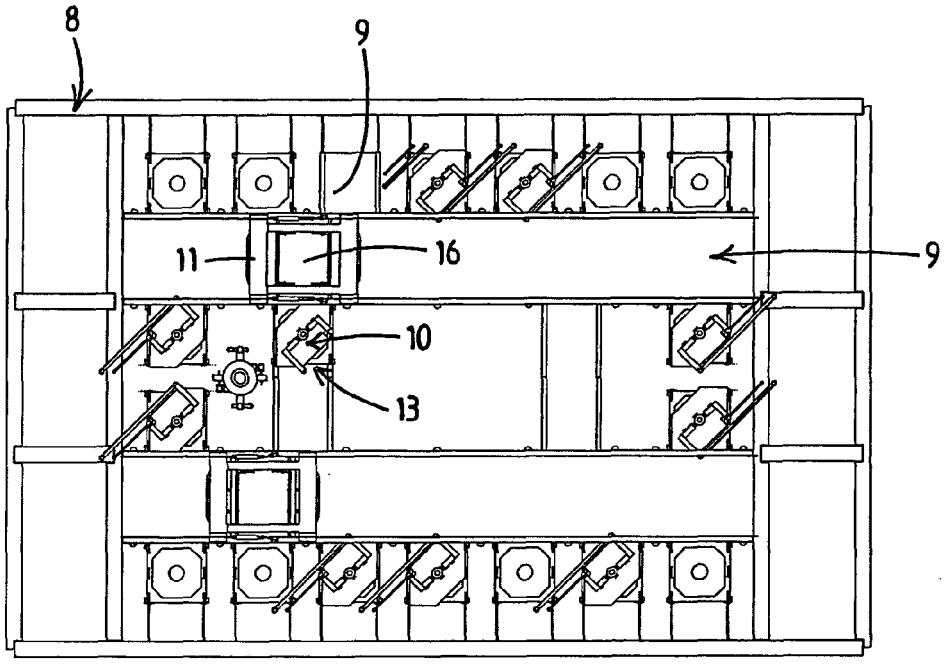
FIG. 7 shows a schematic top view of a the support system of FIG. 2 in a fourth working position.

FIG. 2 shows a schematic perspective view of the support system with multiple supports carts 13 supported in multiple production docks 9. FIG. 3 shows a side view of the same support system. FIGS. 4-7 show the same support system in different subsequent positions of transferring a support cart from a production dock (FIG. 4) to a drilling dock (FIG. 7). FIG. 5 shows a schematic top view of cart 13 supported by a crane 11. The crane 11 supporting a cart 13 is shown in a perspective view in FIG. 8.

In FIG. 5 arrows 21 indicate the movement of the cranes 11 along their transport tracks 19. The arrows 22 indicate the direction of movement of the carts 13, perpendicular to the transport tracks 19 of the cranes 11 for moving in or out of the crane. In the embodiment shown, each crane is able transfer carts between nine production docks and the two drilling docks.

In the exemplary embodiment, the multiple production docks 9 are distributed along the perimeter 18 of the moonpool 3, and the drilling dock 10 is positioned near the centre of the moonpool 3. Such a configuration is beneficial since it minimises the risk of risers coming into contact with, and probably damaging each other during transfer.

Furthermore, by locating the drilling dock in a central position relative to the production docks, the average distance between the different production docks and the drilling dock, i.e. the time needed to for transferring a riser, is limited.

Figure 10:
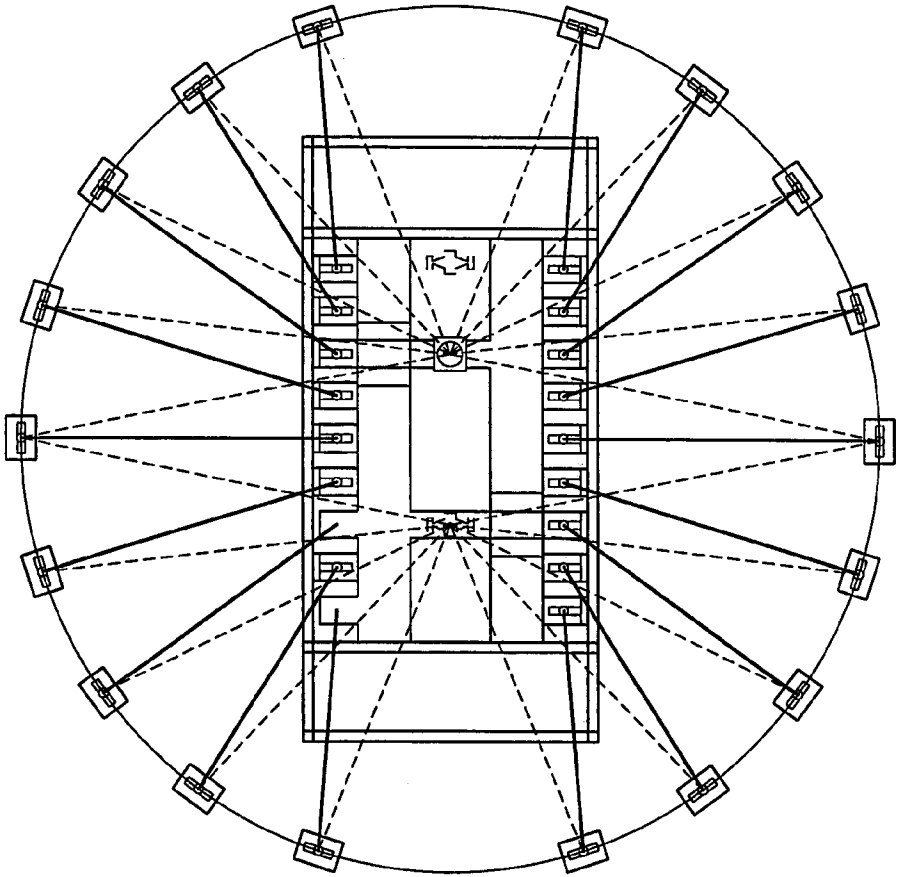
FIG. 10 shows a schematic top view of risers extending between wells and a riser support system according to the invention.

FIG. 10 shows in a top view a riser support system according to the invention, and in particular the risers extending between the wells, distributed in a circular configuration, at the sea floor, and the riser support system. The risers with their upper end supported in a production dock are indicated with a continuous line.

In the riser support system 7 shown, the risers 4 are grouped together in a rectangular moonpool 3 and in a matrix configuration which, in plan view, comprises two rows and tow columns of respectively seven and four production docks 9. Two drilling docks 10 are provided at the centre of the moonpool 3. The discontinuous lines indicate the dock of the specific risers when in a drilling dock. The particular configuration shown provides a simple structure which allows the different risers to be located in the vicinity of the drilling docs. Thus the distance over which the risers need to be moved is minimal which minimizes the tensional force enacted upon the structure by a risers being "bent" out of its position when being transferred in a drilling doc.

The cart support structure is of a substantially rectangular shape. Such a configuration allows for the use of a low cost frame constructed out of straight construction beams.

The docks 9, 10 comprise compartments of an essentially rectangular shape which are disposed parallel to one another. Thus the riser ends can be positioned in a limited area. The compartments of the production docks 9 are open along one side for receiving a cart 13 from one crane 16. The compartments of the drilling docks 10 are open along two, opposite, sides and may receive cart 13 from both cranes 11. Each compartment may thus contain a cart 13 supporting a riser 4, the carts capable of being displaced individually amongst the compartments of a production dock 9 and the compartment of a drilling dock 10.

In the embodiment shown, the carts and there support frames are of a rectangular shape. It is noted that the in principle, a cart may have any shape of form, such as triangular or even spherical, as long as the cart enables support of the riser in a production or drilling dock and transfer of the riser together with its riser tensioners by a crane.

The multiple production docks 9 and the drilling dock 10 are provided on opposite sides of the transport track 19 and at the same level as the transport dock 16 of the crane. By moving the crane 3 along the crane guide 12 the transport dock 16 can thus be positioned next to one of the multiple production docks 9 or the drilling dock 10 for receiving one of the multiple carts 13 supported by that production dock 9 or drilling dock 10 respectively.

The multiple production docks 9 and the drilling dock 10 all comprise cart guides 17 for slideable supporting one of the multiple carts 13. The cart guides extend in a substantial horizontal plane such that one of the carts 13 can be slid in a substantial horizontal direction over the support guides.

The carts comprise a rectangular support frame which is provided with a deck having a central opening for the riser. The support frame is provided with means for connecting riser tensioners, in the particular case one at each corner of the frame. The frame is further provided with guides for interacting with the support guides to enable the cart to slide along the support guides. These guides, as well as the cart guides and the crane guides, may for example be rails for interacting with wheels, siding surfaces or any other guides.

In the embodiment shown each crane guide extends within a substantial horizontal plane above the cart support structure. The guides are I-beams supported on columns, as shown in FIGS. 3 and 4. Alternative guides and rails systems known for moveably supporting a crane can be used in stead of or in combination with the guides shown.

The cranes 3 comprise a frame extending in a downward direction from the crane guide, said frame comprising a transport dock 16 for supporting one of the multiple carts 13.

Figure 8:
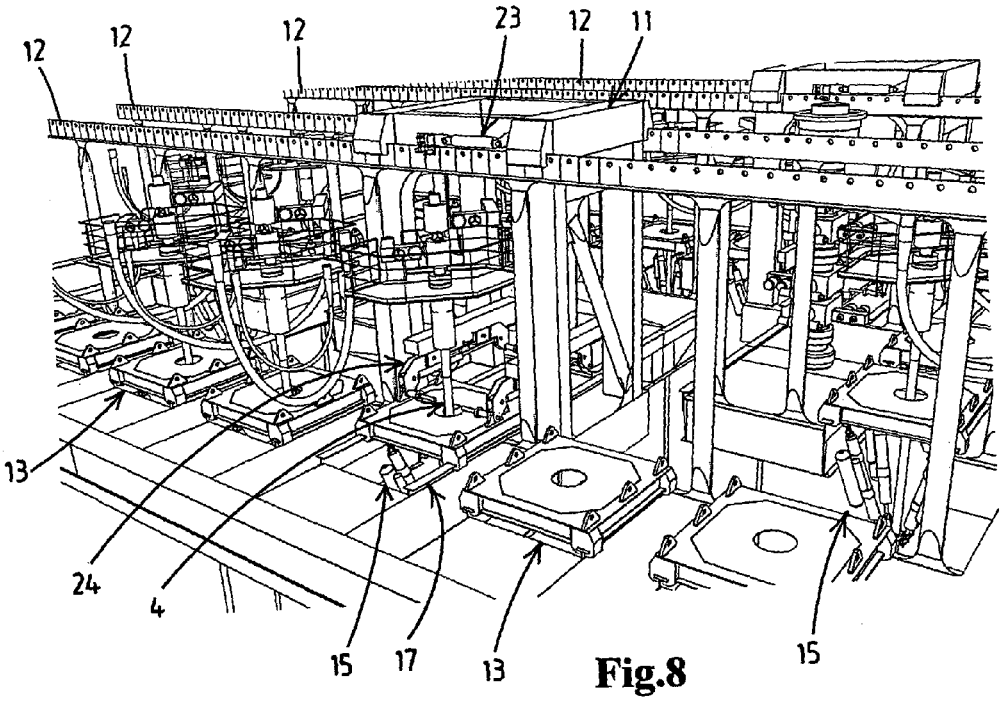
FIG. 8 shows an enlarged schematic perspective view of part of the support system of FIG. 2 in a fifth working position.
Figure 9:
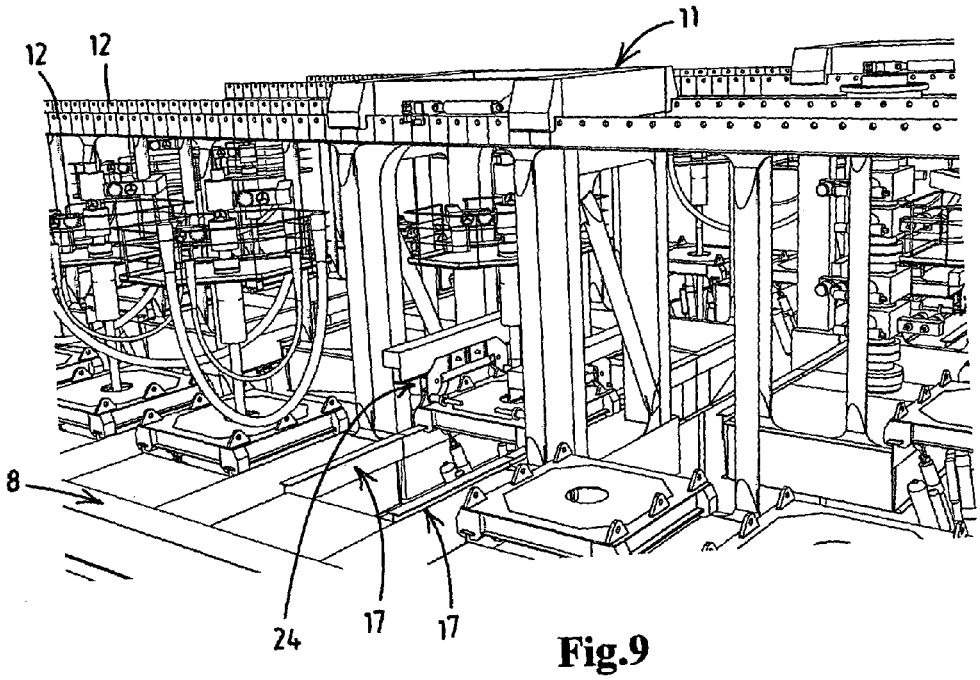
FIG. 9 shows an enlarged schematic perspective view of part of the support system of FIG. 2 in a sixth working position.

FIG. 8 shows a crane 11 positioned next to a production dock 9, and a cart 13 halfway the transfer between the production dock 9 and the transfer dock 16 of the crane. The figure furthermore shows cart 13 supported in the production docks adjacent the production dock next to the crane. FIG. 9 shows the supporting a cart 13 moved into the transport dock 16 of the crane 11.

The crane 11 is supported by the two crane guides 12 on opposite sides of the crane. The frame of the crane comprises an upper part with guides for interacting with the crane guides 12. Thus, the upper part of the crane functions as a carriage for movement of the crane along the crane guide.

The lower part of the crane consists of two vertical legs extending in a downward direction, the legs defining a holding space for holding a cart and the upper end of the riser provided with pressure containment means, located in the transport dock.

The legs of the crane furthermore define two openings on opposite sides of the holding space for movement of a cart into or out of the holding space.

Like the multiple production docks 9 and the drilling dock 10 the transport dock 16 comprises cart guides 17 for slideable supporting one of the multiple carts 13. The cart guides are provided at the lower ends of the legs and extend in a substantial horizontal plane such that one of the carts 13 can be slid in a substantial horizontal direction from one of the multiple production docks 9 or the drilling dock 10 into the transport dock 16 of the crane 11 when positioned next to the one of the multiple production docks 9 or the drilling dock 10 respectively.

The upper ends of the risers are positioned in a production dock practically throughout the entire lifetime of the field. Only certain maintenance operations require the riser to be returned to the firing line of the drilling station.

In the exemplary embodiment, as shown in FIGS. 4-9, for transferring a cart 13 from a production dock 9 to a drilling dock 10, the crane 11 is moved along the crane guide 12 into a dock in which its transport dock 16 is adjacent the production dock 9 of the specific riser 4 to be transferred. When the crane 11 is in this dock, the cart guides 17 in the transport dock 16 of the crane 11 and the cart guides 17 of the production dock 9 for supporting the cart 13 are in alignment with each other. Furthermore, the ends of the cart guides 17 of the production and the transport dock are positioned adjacent each other. Thus the cart 13 can be slid over the cart guides 17 in the production dock 9 onto the support guides 17 of the crane 11 and into the transport dock 16. Both the riser 4 and the riser tensioners 15 are moved when the cart 13 is transferred. The riser 4 can thus be transferred in a simple manner without the need of disconnecting it prior to the transfer and reconnecting it to riser tensioners after the transfer, which safes time and labour.

In the embodiment shown, both the crane 11 and the cart 13 are skidded along their crane guides 12 and cart guides 17, by way of a push pull system 23, 24. Each push-pull system comprises hydraulic cylinders and engagement means, for connecting the push pull unit to the crane with one end and to the crane guide or the cart. Both the crane guide and the support card are provided with multiple connection openings in for connecting to the push pull units.

Both the push pull unit for moving the crane and the push pull unit for moving a cart are fitted with locking devices to prevent module from moving in unwanted directions. It is contemplated that the power to drive the push pull units in a preferred embodiment is delivered by a power unit mounted on the crane. However, the push pull units can be provided with a central power unit, for example mounted on the central part of the cart support structure and provided with connection tubes for connecting to the push pull units, as well.

In addition to moving the cart or crane, such a push pull unit connects for example the crane to the crane guide while pushing or pulling the crane along the guide. Thus the push pull system provides an extra safety, preventing the crane form coming de railing or even falling down form the crane guide.

Push pull units are well known from the art and will therefore not be elaborated upon.

When the support card is not moved relative to its production dock, transport dock or drilling dock, its support frame is preferably connected to the cart support structure. For example, the cart may be provided with holes which align with holes in the cart support structure when positioned in the production dock. When the cart is in the production dock a rod or pin can be inserted into the holes to connect the cart with the cart support structure. Thus the cart is secured against sliding out of the dock during hydrocarbon production or prior to a crane being positioned next to the production dock for receiving the cart.

The riser tensioners connecting the risers to the support frames preferably are hydraulic cylinders provided with means for regulating the pressure in the cylinders provided on the cart, preferably on the tension member. This facilitates movement of the risers together with the riser tensioners.

In an alternative embodiment, the crane may for example be a gantry crane comprising a support beam supported for movement in a substantial horizontal plane above the cart support structure and below the deck supporting the drilling station, the crane comprising a translating carriage which can be moved along the support beam. Thus, the crane may provide overhead access to all the production docks and the at least one drilling dock.

Furthermore, the crane may be provided with extendable lifting means such as a hoist system for lowering a lifting device to connect to a cart such that it can be transferred. When the lifting device is not connected to a cart, the lifting device can be moved in an upward position freeing up space among the riser ends. Also, with the lifting means in the upward location, the crane is not hindered in its movement by the riser ends and/or manifolds mounted on those riser ends.

In addition to transferring carts such a crane may also be used for transferring for example equipment such as pressure containment means (such as a Blow-out Preventer valving arrangement) over and onto any riser supported by a cart.

In a further embodiment the cart support structure may be of a circular shape with a drilling dock located at its centre and the production docks along its perimeter. Such a configuration may comprise one or more cranes moveably along a concentric circular transfer track positioned between the production docks and the drilling dock.

In such an embodiment the at least one crane may be supported by a crane guide extending in a radial direction, which crane guide is movably supported for movement about the drilling dock to enable the crane to transfer the carts between the different peripheral production docks and the central drilling dock.

A riser support system according to the invention may be used with any floating structure for offshore hydrocarbon production to support one or more risers via riser tensioners.

A riser support system according to the invention may also be used for supporting one or more risers or tubular structures not connected to any well. For example, when a riser is disconnected from the well head to enable work on the well head it can be "parked" in another production dock to clear the space above the well head, and be returned after the work is done.

In the embodiment shown, the floating offshore structure is provided with a multipurpose tower having comprising drilling equipment defining a first and a second firing line, e.g. a first and a second drilling dock. The drilling docks are positioned along the transfer track of the cranes. In alternative embodiment, the drilling docks may partly overlap or coincide with the transfer track. In such an embodiment a riser may be supported by the crane in the drilling dock. Such a configuration may provide a more compact lay out.

Furthermore, in an alternative embodiment a drilling station could be provided with only one firing line, which tower is moveable supported for movement along a limited transfer track to enable use of the tower with two or more drilling docks. In such a configuration a second riser can be positioned in the second drilling dock while the first riser in the first drilling dock is engaged by the drilling station.

Also, the moonpool could be located out of the centre of the floating structure, for example along the side of the floating structure only limited on three sides by the floating structure and open its third side.

Also, the drilling can straddle the moonpool with its firing line in the centre of said moonpool, or for example be located near the edge of the moonpool providing an off centre drilling dock.

The invention is by no means limited to the exemplary embodiment described herein above, but comprises various modifications hereto, in so far as they fall within the scope of the following claims.

The invention claimed is:

1. A floating offshore structure for offshore hydrocarbon production, the offshore structure comprising:

a moonpool for receiving multiple production risers having a lower end connected to a hydrocarbon well on a sea floor and an upper end located in the moonpool;

a drilling station located at the moonpool, the drilling station comprising drilling equipment defining a firing line;

a production riser support system for supporting the multiple risers at their upper ends while lower ends are connected to the hydrocarbon well, the production riser support system comprising:

a plurality of carts, each cart comprising:

a support frame; and one or more riser tensioners for connecting the support frame to the upper end of one of the multiple risers while the lower ends are connected to the hydrocarbon well, such that each cart is suitable for in a production dock supporting one of the multiple risers in a production position, and in a drilling dock supporting one of the multiple risers in a drilling position under the drilling station and in line with the firing line;

a cart support structure, the cart support structure defining multiple production docks and at least one drilling dock, each dock suitable for supporting one of said carts; and a crane which is movable supported by a crane guide for movement along a transport track, the crane guide extends within a substantial horizontal plane and bridges at least part of the moonpool, for transferring one of the multiple carts between one of the multiple production docks and the at least one drilling dock, wherein each cart is suitable for being transferred by the crane between a production dock and the drilling dock.

2. A floating offshore structure according to claim 1, wherein the crane guide extends within a substantial horizontal plane above the cart support structure and the crane comprises a frame extending in a downward direction from the crane guide, said frame comprising a transport dock for supporting one of the multiple carts.

3. A floating offshore structure according to claim 2, wherein the multiple production docks and the drilling dock are provided on opposite sides of the transport track and at the same level as the transport dock of the crane, such that by moving the crane along the crane guide its transport dock can be positioned next to one of the multiple production docks or the drilling dock for receiving one of the multiple carts supported by that production dock or drilling dock respectively.

4. A floating offshore structure according to claim 3, wherein the multiple production docks, the drilling dock and the transport dock all comprise cart guides for slideable supporting one of the multiple carts, the cart guides extending in a substantial horizontal plane such that one of the carts can be slid in a substantial horizontal direction from one of the multiple production docks or the drilling dock into the transport dock of the crane when positioned next to the one of the multiple production docks or the drilling dock respectively.

5. A floating offshore structure according to claim 1, wherein the multiple production docks are distributed along the perimeter of the moonpool, and the drilling dock is positioned near the centre of the moonpool.

6. A floating offshore structure according to claim 1, wherein the crane guide extends in a linear direction.

7. A floating offshore structure according to claim 1, wherein the cart support structure is of a substantially rectangular shape.

8. A floating offshore structure according to claim 1, wherein the production docks and the drill docks are distributed in a symmetrical array configuration in the moonpool.

9. A floating offshore structure according to claim 1, wherein the crane comprises a push-pull system for moving the crane along the crane guide.

10. A floating offshore structure according to claim 1, wherein the crane comprises a push-pull system for moving one of the multiple carts from a production dock to the transport dock and visa versa.

11. A floating offshore structure according to claim 1, wherein the offshore structure is a tension leg platform.

12. Riser support system for use in a floating offshore structure according to claim 1.

13. A floating offshore structure according to claim 2, wherein the multiple production docks are distributed along the perimeter of the moonpool, and the drilling dock is positioned near the centre of the moonpool.

14. A floating offshore structure according to claim 3, wherein the multiple production docks are distributed along the perimeter of the moonpool, and the drilling dock is positioned near the centre of the moonpool.

15. A floating offshore structure according to claim 4, wherein the multiple production docks are distributed along the perimeter of the moonpool, and the drilling dock is positioned near the centre of the moonpool.

16. A floating offshore structure according to claim 2, wherein the crane guide extends in a linear direction.

17. A floating offshore structure according to claim 3, wherein the crane guide extends in a linear direction.

18. A floating offshore structure according to claim 4, wherein the crane guide extends in a linear direction.

19. A floating offshore structure according to claim 5, wherein the crane guide extends in a linear direction.

20. A floating offshore structure according to claim 2, wherein the cart support structure is of a substantially rectangular shape.

* * * * *